US009142189B2

(12) United States Patent
Choi et al.

(10) Patent No.: US 9,142,189 B2
(45) Date of Patent: Sep. 22, 2015

(54) BACKLIGHT UNIT AND DISPLAY DEVICE INCLUDING THE SAME

(71) Applicant: Samsung Display Co., Ltd., Yongin, Gyeonggi-Do (KR)

(72) Inventors: SeungYoung Choi, Yongin-si (KR); Min-Soo Choi, Asan-si (KR); Hwanwoong Lee, Asan-si (KR); Gwangteak Lee, Cheonan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 196 days.

(21) Appl. No.: 13/767,170

(22) Filed: Feb. 14, 2013

(65) Prior Publication Data

US 2014/0111497 A1 Apr. 24, 2014

(30) Foreign Application Priority Data

Oct. 23, 2012 (KR) ..... 10-2012-0118025

(51) Int. Cl.
*G09G 5/10* (2006.01)

(52) U.S. Cl.
CPC ..... *G09G 5/10* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,061,779 | B2 | 6/2006 | Yang | |
| 7,161,331 | B2 | 1/2007 | Wai et al. | |
| 7,723,924 | B2 | 5/2010 | Han et al. | |
| 7,999,409 | B2 | 8/2011 | Wang et al. | |
| 8,218,096 | B2 * | 7/2012 | Cha et al. | 349/15 |
| 2009/0096387 | A1 * | 4/2009 | Fang et al. | 315/297 |
| 2010/0176736 | A1 | 7/2010 | Lee et al. | |
| 2010/0182814 | A1 | 7/2010 | Tada et al. | |
| 2011/0043510 | A1 | 2/2011 | Kim et al. | |
| 2011/0075057 | A1 | 3/2011 | Kim et al. | |
| 2011/0316449 | A1 | 12/2011 | Imanaka | |
| 2012/0025720 | A1 * | 2/2012 | Chen et al. | 315/185 R |
| 2012/0038690 | A1 * | 2/2012 | Lee | 345/691 |
| 2012/0044718 | A1 | 2/2012 | Young et al. | |
| 2012/0194660 | A1 * | 8/2012 | Nakamura et al. | 348/56 |

FOREIGN PATENT DOCUMENTS

| | | | |
|---|---|---|---|
| KR | 1020060004281 | A | 1/2006 |
| KR | 1020060034462 | A | 4/2006 |
| KR | 1020080106699 | A | 12/2008 |

* cited by examiner

*Primary Examiner* — Dwayne Bost
*Assistant Examiner* — Robert Michaud
(74) *Attorney, Agent, or Firm* — Cantor Colburn LLP

(57) ABSTRACT

A backlight unit includes a power supply converter including a primary winding connected to an input power supply voltage, and a secondary winding which is connected to an output node and outputs a light emitting diode drive voltage to the output node in response to a mode signal and a switching control signal; and a light emitting diode string connected to the output node of the power supply converter, where the power supply converter serially connects a boosting winding to the secondary winding and the output node and when the mode signal represents a three dimensional image display mode, and outputs a boosted light emitting diode drive voltage to the output node through the boosting winding.

20 Claims, 6 Drawing Sheets

BACKLIGHT UNIT AND DISPLAY DEVICE INCLUDING THE SAME

This application claims priority to Korean Patent Application No. 10-2012-0118025, filed on Oct. 23, 2012, and all the benefits accruing therefrom under 35 U.S.C. §119, the content of which in its entirety is herein incorporated by reference.

BACKGROUND

1. Field

Exemplary embodiments of the invention relate to a backlight unit and a display device including the backlight unit.

2. Description of the Related Art

A conventional display device displays a two dimensional flat image. As a demand for three-dimensional ("3D") image increases in various fields such as a movie, a medical image, a game, an advertisement, an education, military, etc., a 3D image display device has been developed.

A three-dimensional display device displays a 3D image using a principle of binocular parallax through the eyes of a viewer. For example, since the eyes of the viewer are spaced a predetermined distance apart from each other, images observed by each eye from different angles are input to the brain of the viewer. A 3D image device allows the viewer to perceive a 3D effect and to sense a depth through the process described above.

A 3D display device may be classified into a stereoscopic type 3D display device and an auto-stereoscopic type 3D display device according to whether a viewer wears on special glasses or not to perceive the 3D effect. The steroscopic type 3D display device typically uses a polarizing method and a shutter glass method, and the auto-steroscopic type 3D display device typically uses a parallax barrier method and a lenticular method.

In the shutter method, when a left-eye image and a right-eye image are displayed on a display panel by a frame unit, a 3D image is realized by alternately opening and closing a left shutter and a right shutter of the shutter glasses in synchronization with the frame unit. In a 3D image display device including a liquid crystal display device, when a right-eye image is displayed during a right eye section after a left-eye image is displayed during a left eye section, the left-eye image may affect the right-eye image due to a slow response speed of the liquid crystal such that an image quality may be deteriorated. The deterioration of image quality may be effectively prevented by periodically turning a backlight unit of the liquid crystal display device on and off. That is, after turning a backlight unit off after a left-eye image is displayed on a display panel, the backlight unit is turned on again when a right-eye image is displayed in the display panel.

SUMMARY

An exemplary embodiment of the invention provides a backlight unit which includes: a power supply converter including a primary winding connected to an input power supply voltage, and a secondary winding which is connected to an output node and outputs a light emitting diode drive voltage to the output node in response to a mode signal and a switching control signal; and a light emitting diode string connected to the output node of the power supply converter, where the power supply converter serially connects a boosting winding to the secondary winding and the output node and when the mode signal represents a three dimensional image display mode, and outputs a boosted light emitting diode drive voltage to the output node through the boosting winding.

Another exemplary embodiment of the invention provides a display device which includes a display panel including a plurality of pixels; a drive circuit which controls the display panel to display an image on the display panel; and a backlight unit which supplies light to the display panel, where the backlight unit includes: a power supply converter which outputs a light emitting diode drive voltage to an output node in response to a mode signal and a switching control signal, where the power supply converter includes a primary winding connected to an input power supply voltage, and a second winding connected to the primary winding and the output node; a light emitting diode string connected to the output node of the power supply converter, where the power supply converter serially connects a boosting winding to the secondary winding when the mode signal represents a three-dimensional image display mode, and outputs a boosted light emitting diode drive voltage to the output node through the boosting winding.

BRIEF DESCRIPTION OF THE DRAWINGS

The above and other features of the invention will become readily apparent by describing in detailed exemplary embodiments thereof with reference to the accompanying drawings, in which.

DETAILED DESCRIPTION

Figure 1:
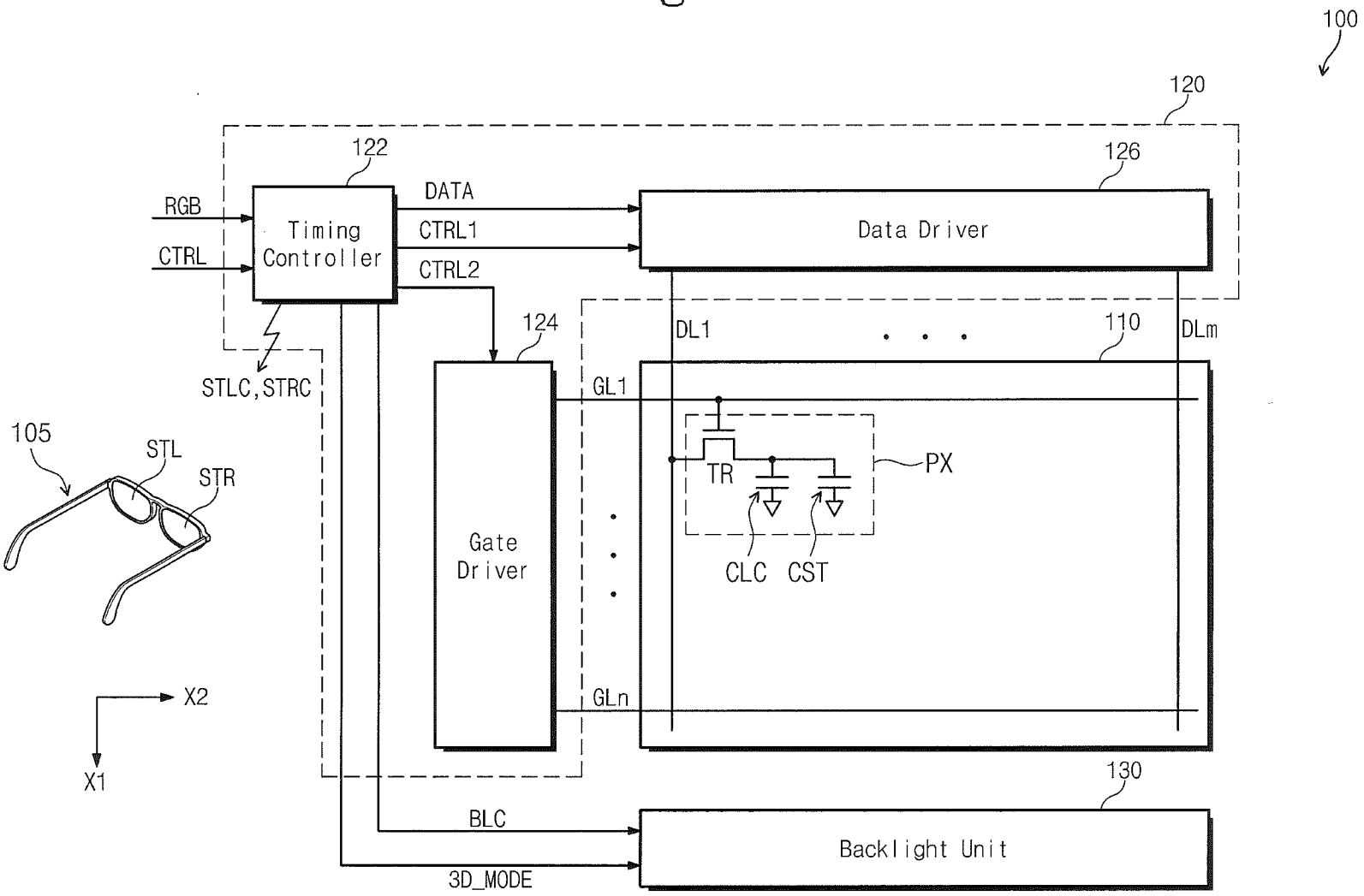
FIG. 1 is a block diagram illustrating an exemplary embodiment of a display device according to the invention.

The invention will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in detail with reference to the accompanying drawings.

FIG. 1 is a block diagram illustrating an exemplary embodiment of a display device according to the invention.

Referring to FIG. 1, a display device 100 includes a display panel 110, a drive circuit 120 and a backlight unit 130. The display device 100 may further include shutter glasses 105.

The display panel 110 displays an image. In an exemplary embodiment, the display panel 110 is a liquid crystal display panel, but not being limited thereto. The display panel 110 may be different types of display panels that include the backlight unit 130.

The display panel 110 includes a plurality of gate lines GL1 to GLn extending in a second direction X2, a plurality of data lines DL1 to DLm extending in a first direction X1 and a plurality of pixels PX arranged substantially in a matrix form and connected to the gate lines GL1 to GLn and data lines DL1 to DLm, which cross each other. The gate lines GL1 to GLn and the data lines DL1 to DLm are insulated from each other. Each of the pixels PX includes a thin film transistor TR, a liquid crystal capacitor CLC and a storage capacitor CST.

The pixels PX may have the same structure as each other. A thin film transistor TR of each of the pixels PX includes a gate electrode connected to a corresponding gate line, e.g., a first gate line GL1, of the gate lines GL1 to GLn, a source electrode connected to a corresponding data line, e.g., a first data line DL1, of the data lines DL1 to DLm and a drain electrode connected to the liquid crystal capacitor CLC and the storage capacitor CST. One end of the liquid crystal capacitor CLC and one end of the storage capacitor CST are connected to the drain electrode of the thin film transistor TR. The other end of liquid crystal capacitor CLC and the other end of the storage capacitor CST are connected to a common voltage.

The drive circuit 120 includes a timing controller 122, a gate driver 124 and a data driver 126. The timing controller 122 receives an image signal RGB and a control signal CTRL from outside. The control signal CTRL includes a vertical synchronizing signal, a horizontal synchronizing signal, a main clock signal and a data enable signal. The timing controller 122 processes the image signal RGB based on an operation condition of the display panel 110 and the control signal CTRL, and generates a data signal DATA, a first control signal CTRL1 and a second control signal CTRL2. The timing controller 122 provides the data signal DATA and the first control signal CTRL1 to the data driver 126 and provides the second control signal CTRL2 to the gate driver 124. The first control signal CTRL1 may include a horizontal synchronizing starting signal, a clock signal and a line latch signal. The second control signal CTRL2 may include a vertical synchronizing starting signal, an output enable signal and a gate pulse signal. The timing controller 122 may generate the data signal DATA based on an arrangement of the pixels PX of the display panel 110 and a display frequency. In an exemplary embodiment, where the display device displays a three-dimensional ("3D") image, the timing controller 122 sequentially outputs a left-eye image signal and a right-eye image signal as the data signal DATA during a 3D image display mode.

The timing controller 122 provides a backlight control signal BLC and a mode signal 3D_MODE for controlling the backlight unit 130 and outputs a left eye shutter control signal STLC and a right eye shutter control signal STRC for controlling a left eye shutter STL and a right eye shutter STR of the shutter glasses 105, respectively.

The gate driver 124 drives the gate lines GL1 to GLn in response to the second control signal CTRL2 provided from the timing controller 122. The gate driver 124 may include a gate drive integrate circuit. The gate driver 124 may be realized by a circuit using an oxide semiconductor, an amorphous semiconductor, a crystalline semiconductor or a polycrystalline semiconductor, for example.

The data driver 126 drives the data lines DL1 to DLm in response to the data signal DATA and the first control signal CTRL1 provided from the timing controller 122.

The backlight unit 130 is disposed at a lower side of the display panel 110 and opposite to, e.g., facing, the pixels PX. The backlight unit 130 operates in response to the backlight control signal BLC and the mode signal 3D_MODE provided from the timing controller 122.

The shutter glasses 105 open and close the left eye shutter STL in response to the left eye shutter control signal STLC and open and close the right eye shutter STR in response to the right eye shutter control signal STRC. The timing controller 122 may include a wireless transmission part which transmits the left eye shutter control signal STLC and the right eye shutter control signal STRC by wireless transmission. The shutter glasses 105 may include a wireless reception portion that receives the left eye shutter control signal STLC and the right eye shutter control signal STRC. While a left-eye image is displayed on the display panel 110, the left eye shutter STL of the shutter glasses 105 is open and the right eye shutter STR of the shutter glasses 105 is closed. While a right-eye image is displayed on the display panel 110, the left eye shutter STL of the shutter glasses 105 is closed and the right eye shutter STR of the shutter glasses 105 is open. Therefore, a user wearing the shutter glasses 105 perceives a 3D image.

Figure 2:
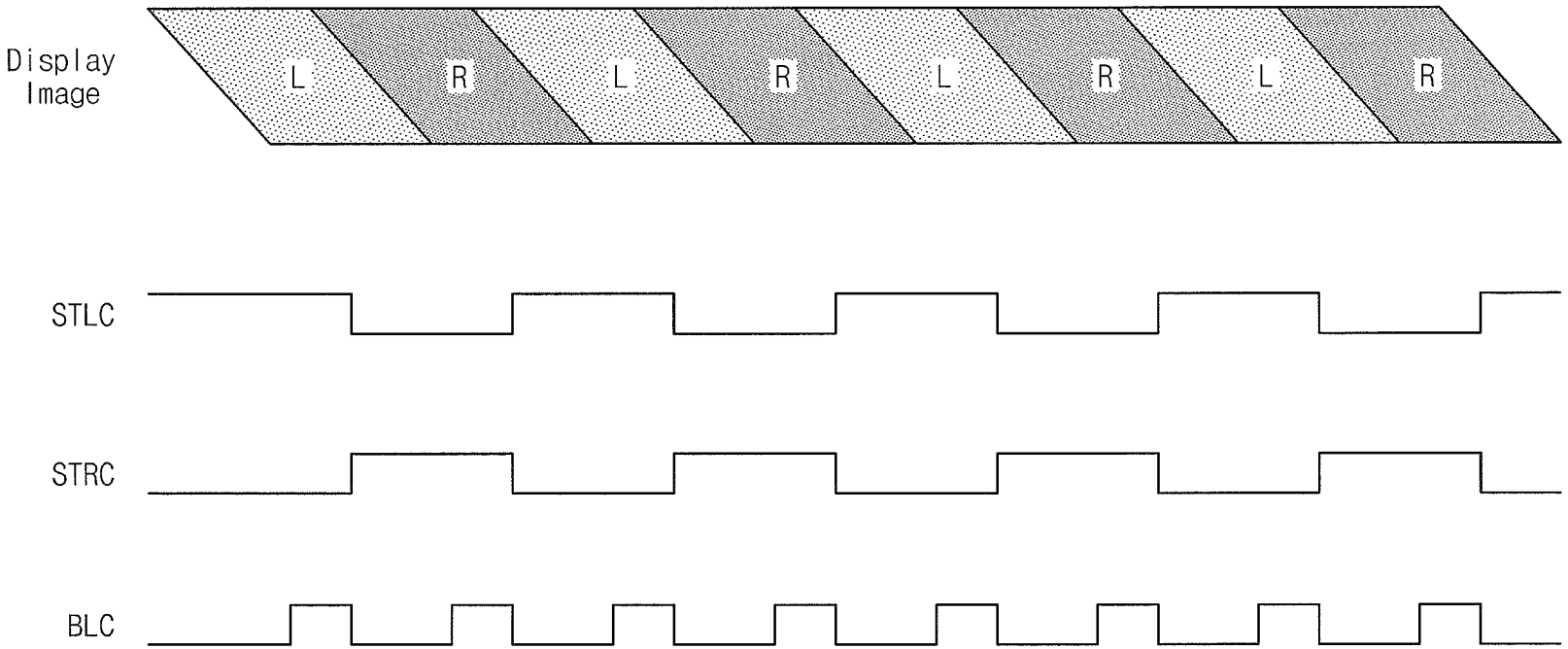
FIG. 2 is a signal timing diagram illustrating a relation between an image displayed on the display device illustrated in FIG. 1, and a backlight control signal, a left eye shutter control signal and a right eye shutter control signal.

FIG. 2 is a signal timing diagram illustrating a relation between an image displayed on the display device illustrated in FIG. 1, and a backlight control signal, a left eye shutter control signal and a right eye shutter control signal.

Referring to FIG. 2, as the gate lines GL1 to GLn illustrated in FIG. 1 is sequentially driven during a left eye frame, a left-eye image signal L is displayed on the display panel 110. As the gate lines GL1 to GLn illustrated in FIG. 1 is sequentially driven during a right eye frame, a right-eye image signal R is displayed on the display panel 110.

The timing controller 122 illustrated in FIG. 1 outputs the left eye shutter control signal STLC and the right eye shutter control signal STRC such that the left eye shutter STL of the shutter glasses 105 is open and the right eye shutter STR of the shutter glasses 105 is closed while the left-eye image L is displayed on the display panel 110. Similarly, the timing controller 122 outputs the left eye shutter control signal STLC and the right eye shutter control signal STRC such that the left eye shutter STL of the shutter glasses 105 is closed and the right eye shutter STR of the shutter glasses 105 is open while the right-eye image R is displayed on the display panel 110.

The backlight control signal BLC output from the timing controller 122 is set to be in a high level during a section shorter than a high level section of each of the left eye shutter control signal STLC and the right eye shutter control signal STRC. After a predetermined time passed after each of the left eye shutter control signal STLC and the right eye shutter control signal STRC transit from a low level to a high level, the backlight control signal BLC transits to a high level based on a slow response speed of the liquid crystal capacitor CLC.

In an exemplary embodiment, the backlight unit 130 is periodically turned on and turned off by the backlight control signal BLC to minimize a cross talk phenomenon that may occur when a right-eye image displayed in a right eye section remains in a left-eye image displayed in a left eye section as an afterimage. In an exemplary embodiment, when the backlight unit 130 is turned on and turned off in every output frame, brightness of an image displayed on the display panel 110 may be deteriorated as compared with when the backlight unit 130 is successively turned on in a normal mode.

Figure 3:
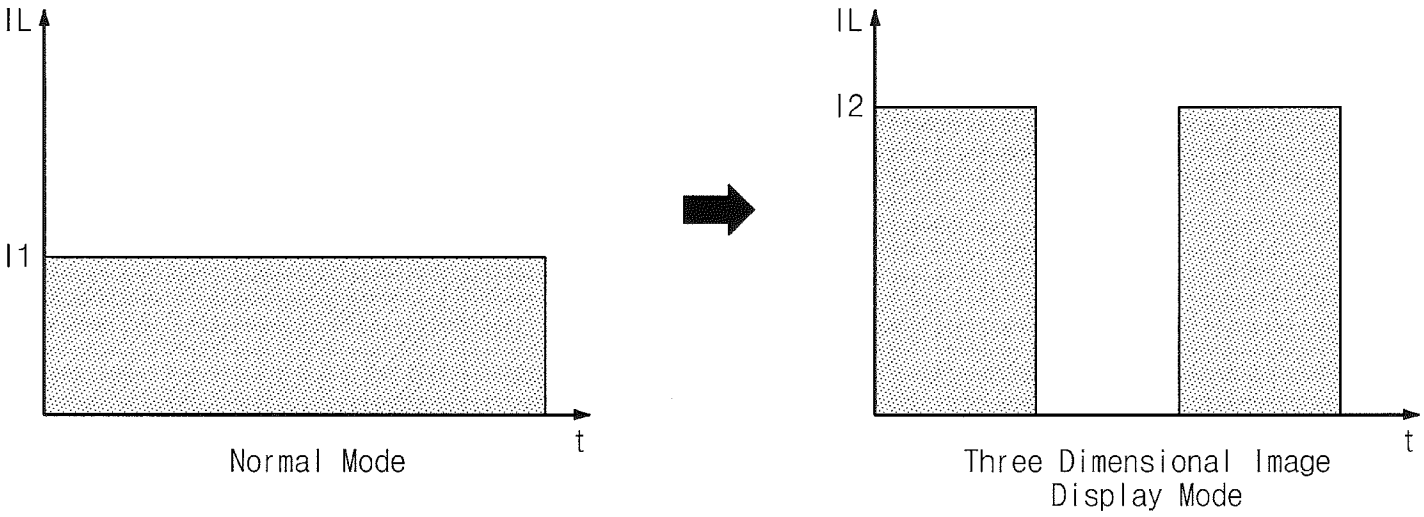
FIG. 3 is a drawing illustrating a change of current in a backlight unit according to an operation mode of the display device illustrated in FIG. 1.

FIG. 3 is a drawing illustrating a change of current in a backlight unit according to an operation mode of the display device illustrated in FIG. 1.

FIG. 3 shows graphs of current level (IL) versus time (t). Referring to FIG. 3, when a current of first level I1 is generated in the backlight unit 130 during a normal mode, the current generated in the backlight unit 130 increases to a second level I2 as the backlight unit 130 is periodically turned on and turned off during a 3D image display mode.

Figure 4:
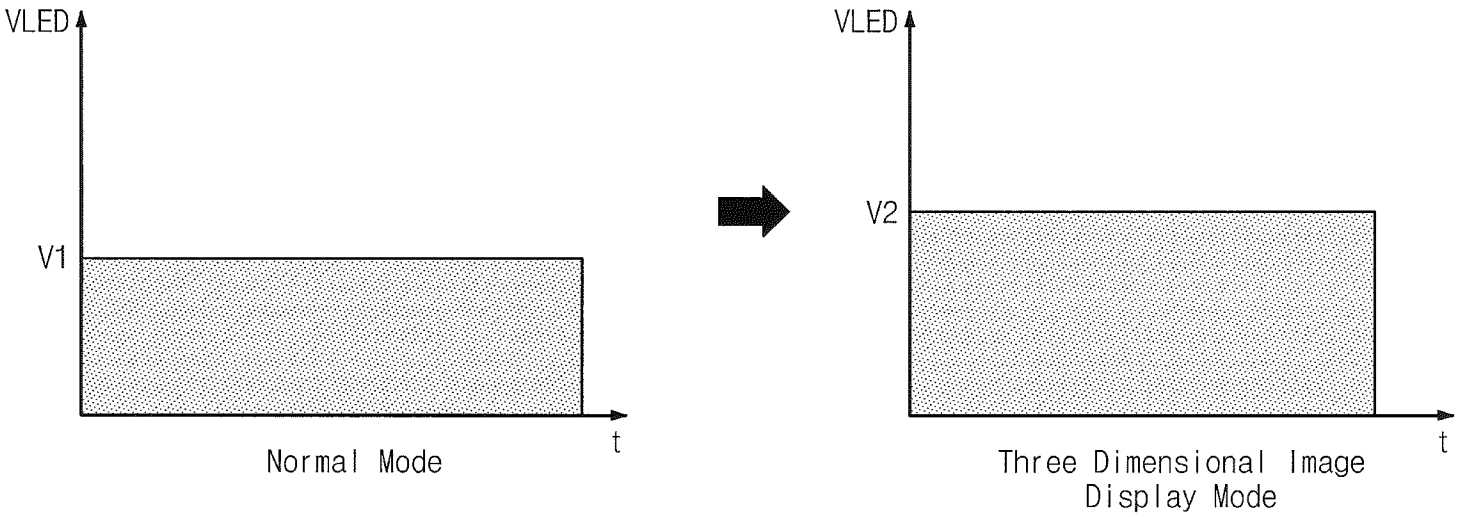
FIG. 4 is a drawing illustrating a change of light emitting diode ("LED") drive voltage of a backlight unit according to an operation mode of the display device illustrated in FIG. 1.

FIG. 4 is a drawing illustrating a change of light emitting diode ("LED") drive voltage of a backlight unit according to an operation mode of the display device illustrated in FIG. 1.

Referring to FIGS. 3 and 4, as the current in the backlight unit 130 during the 3D image display mode increases to the second level I2, a voltage level V2 of a LED drive voltage VLED provided to a light source (not shown) of the backlight unit 130 during the 3D image display mode rises above a voltage level V1 in normal mode. In an exemplary embodiment, a voltage level of the LED drive voltage VLED increases during the 3D image display mode such that deterioration of brightness due to periodical blinking of the light source in the backlight unit during the 3D image display mode is effectively prevented.

Figure 5:
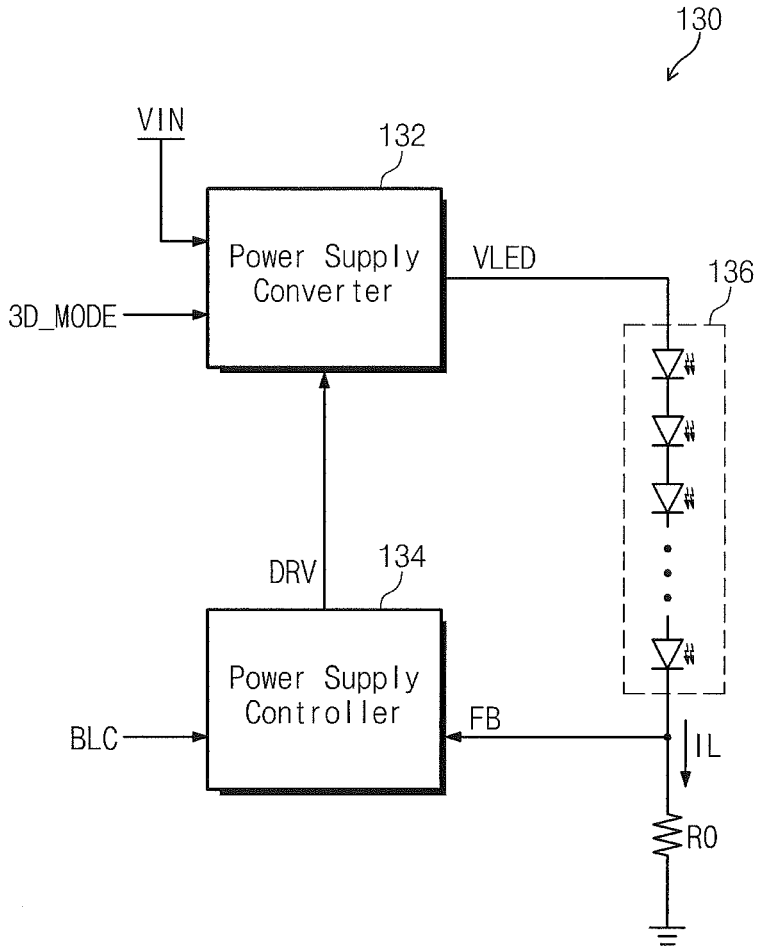
FIG. 5 is a block diagram illustrating an exemplary embodiment of a backlight unit illustrated in FIG. 1.

FIG. 5 is a block diagram illustrating an exemplary embodiment of a backlight unit illustrated in FIG. 1.

Referring to FIGS. 1 and 5, the backlight unit 130 includes a power supply converter 132, a power supply controller 134, a light source 136 and a resistor R0. The power supply converter 132 receives an input power supply voltage VIN from outside and generates the LED drive voltage VLED in response to the mode signal 3D_MODE provided from the timing controller 122. The power supply converter 132 generates the LED drive voltage VLED of normal level when the mode signal 3D_MODE represents a normal mode to provide the LED drive voltage VLED of normal level to the light source 136. The power supply converter 132 generates the LED drive voltage VLED of high level, e.g., a boosted LED driving voltage, when the mode signal 3D_MODE represents a 3D image display mode to provide the LED drive voltage VLED of high level to the light source 136. In such an embodiment, a voltage level of the LED drive voltage VLED provided to the light source 136 is determined based on the mode signal 3D_MODE.

The power supply controller 134 generates a switching control signal DRV in response to the backlight control signal BLC provided from the timing controller 122 and a feedback signal FB.

The light source 136 includes an LED string including a plurality of LEDs serially connected to each other. In one exemplary embodiment, for example, the light source 136 includes a single LED string. In an alternative exemplary embodiment, the light source 136 may include a plurality of LED strings. Each of the LEDs in a LED string may be a red LED, a blue LED, a green LED, a white LED, a cyan LED, a magenta LED, a yellow LED, or combinations thereof. One end, e.g., a first end, of the light source 136 is connected to the drive voltage VLED of the power supply converter 132 and the other end, e.g., a second end, is connected to the resistor R0. One end, e.g., a first end, of the resistor R0 is connected to the other end of the light source 136, and the other end, e.g., a second end, of the resistor R0 is connected to a ground voltage. The feedback signal FB from the other end of the light source 136 is input to the power supply controller 134.

The power supply controller 134 outputs the switching control signal DRV for controlling a voltage level of the LED drive voltage VLED based on the feedback signal FB. In one exemplary embodiment, for example, when a current level of the feedback signal FB becomes low, the power supply controller 134 outputs the switching control signal DRV so that a voltage level of the LED drive voltage increases, and when a current level of the feedback signal FB becomes high, the power supply controller 134 outputs the switching control signal DRV so that a voltage level of the LED drive voltage decreases.

The power supply controller 134 outputs the switching control signal DRV for controlling a LED drive voltage generating operation of the power supply converter 132 in response to the backlight control signal BLC. In one exemplary embodiment, for example, when the backlight control signal BLC is in a high level, the power supply controller 134 outputs the switching control signal DRV so that the LED drive voltage VLED is generated, and when the backlight control signal BLC is in a low level, the power supply controller 134 outputs the switching control signal DRV so that the LED drive voltage VLED is not generated. In an exemplary embodiment, a generation of the LED drive voltage VLED may be controlled by the switching control signal DRV. In such an embodiment, a voltage level of the LED drive voltage VLED may be controlled by the switching control signal DRV.

Figure 6:
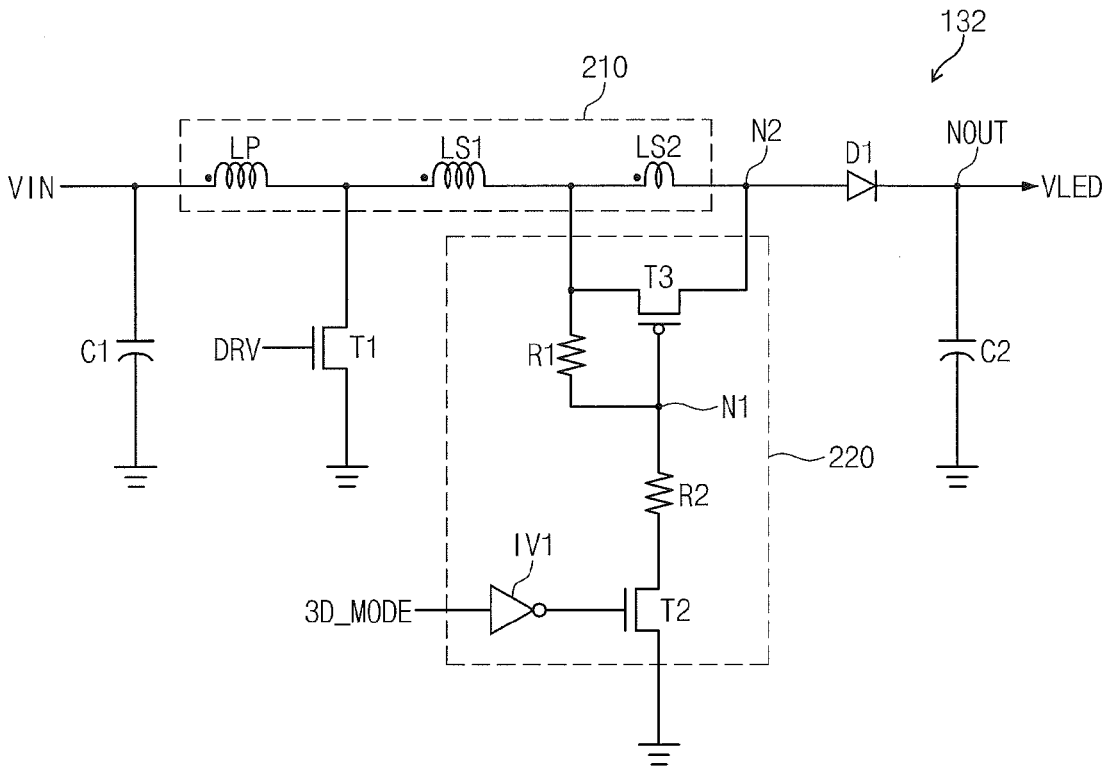
FIG. 6 is a circuit diagram illustrating an exemplary embodiment of a power supply converter illustrated in FIG. 5.

FIG. 6 is a circuit diagram illustrating an exemplary embodiment of a power supply converter illustrated in FIG. 5.

Referring to FIG. 6, the power supply converter 132 includes a coupled inductor 210, a bypass control circuit 220, capacitors, e.g., a first capacitor C1 and a second capacitor C2, a transistor T1 and a diode D1.

The coupled inductor 210 includes a primary winding LP and secondary windings, e.g., a first secondary winding LS1 and a second secondary winding LS2. The second secondary winding LS2 operates as a boosting winding that selectively boosts a LED drive voltage VLED. Hereinafter, the second secondary winding LS2 will be referred to as a boosting winding. One end, e.g., a first end, of the primary winding LP is connected to an input power supply voltage VIN, and the other end, e.g., a second end, of the primary winding LP is connected to one end, e.g., a first end, of the first secondary winding LS1. One end, a first end, of the first secondary winding LS1 is connected to the other end of the primary winding LP, and the other end, e.g., a second end, of the first secondary winding LS1 is connected to one end, a first end, of the boosting winding LS2. One end of, the first end, the boosting winding LS2 is connected to the other end, e.g., the second end, of the secondary winding LS1, and the other end, a second end, of the boosting winding LS2 is connected to a second node N2. The diode D1 is connected between the second node N2 and an output node NOUT.

The first capacitor C1 is connected between one end, e.g., the first end, of the primary winding LP, to which the input power supply voltage VIN is supplied, and a ground voltage, and the second capacitor C2 is connected between the output node NOUT and the ground voltage. A current path of the first transistor T1 is formed between the ground voltage and a connection node of the primary winding LP and the secondary winding LS1. The transistor of the power supply converter 132, e.g., a first transistor T1, includes a gate terminal connected to a switching control signal DRV.

The bypass control circuit 220 includes a bypass unit that bypasses the first and second ends of the boosting winding LS2 in response to a bypass signal. In an exemplary embodiment, the bypass unit may include a transistor, e.g., a third transistor T3, and a current path of the third transistor T3, is formed between both ends, e.g., the first and second ends, of the boosting winding LS2. The third transistor T3 includes a gate terminal connected to the bypass signal generated in the bypass control circuit 220.

The bypass control circuit 220 includes resistors, e.g., a first resistor R1 and a second resistor R2, transistors, e.g., second and third transistors T2 and T3, and an inverter IV1. One end, e.g., a first end, of the first resistor R1 is connected to one end, e.g., the first end, of the boosting winding LS2 and the other end, e.g., a second end, of the first resistor R1 is connected to a first node N1. One end, e.g., a first end, of the second resistor R2 is connected to the first node N1. The second transistor T2 includes a current path formed between the other end, e.g., a second end, of the second resistor R2 and the ground voltage, and a gate connected to an output terminal of the inverter IV1. The inverter IV1 includes an input terminal that receives the mode signal 3D_MODE output from the timing controller 122 illustrated in FIG. 1 and the output terminal. A signal of the first node N1 is the bypass signal, and the first node N1 is connected to a gate of the third transistor T3. In an exemplary embodiment, the first and second transistors T1 and T2 are N-type metal-oxide-semiconductor ("NMOS") transistors, and the third transistor T3 is a P-type metal-oxide-semiconductor ("PMOS") transistor.

Hereinafter, an operation of the power supply converter 132 will be described in detail.

In an exemplary embodiment, when the mode signal 3D_MODE has a low level corresponding to a normal mode, the output terminal of the inverter IV1 outputs a signal of high level. Thus, the second transistor T2 is turned on, and the bypass signal at the first node N1 is thereby lowered to the ground voltage level. When the third transistor T3 is turned on in response to the bypass signal in the ground voltage level, a bypass path is formed between the secondary winding LS1 and the second node N2 through the third transistor T3. As a result, the LED drive voltage VLED generated by the primary winding LP and the first secondary winding LS1 is output through the output node NOUT.

In such an embodiment, when the mode signal 3D_MODE has a high level corresponding to a 3D image display mode, the output terminal of the inverter IV1 outputs a signal of low level. Thus, the second transistor T2 is turned off. As a voltage level of the bypass signal at the first node N1 increases through the resistor R1, the third transistor T3 is turned off. When the third transistor T3 is turned off, the secondary winding LS 1 is serially connected to the boosting winding LS2, and the LED drive voltage VLED boosted through the first secondary winding LS1 and the boosting winding LS2 is output through the output node NOUT.

Equation 1 shows a winding ratio of the number $N_{LP}$ of windings in the primary winding LP to the number $N_{LS1}$ of windings in the secondary winding LS1 in the normal mode.

$$\frac{LVDD}{VIN} = \frac{N_{LS1}}{N_{LP}} \quad \text{[Equation 1]}$$

Equation 2 shows that in the 3D image display mode, the LED drive voltage VLED is increased by the number of windings in the boosting winding LS2 as the secondary winding LS1 is serially connected to the boosting winding LS2.

$$\frac{LVDD}{VIN} = \frac{N_{LS1} + N_{LS2}}{N_{LP}} \quad \text{[Equation 2]}$$

Therefore, by setting the number $N_{LS2}$ of windings in the boosting winding LS2 corresponding to a voltage difference between the LED drive voltage VLED in the normal mode and the LED drive voltage VLED in the 3D image display mode, the power supply converter 132 outputs the LED drive voltage VLED boosted in the 3D image display mode.

When a current level of the feedback signal FB is lower than a reference level, the power supply controller 134 increases a duty ratio of the switching control signal DRV. When a current level of the feedback signal FB is higher than a reference level, the power supply controller 134 lowers a duty ratio of the switching control signal DRV. In such an embodiment, turn-on/turn-off time of the first transistor T1 is controlled based on a duty ratio of the switching control signal DRV during the normal mode and the 3D image display mode, and a voltage level of the LED drive voltage VLED is thereby controlled.

In an exemplary embodiment, as described in FIG. 5, while the backlight signal BLC provided from the timing controller 122 has a low level, the power supply controller 134 outputs the switching control signal DRV of low level. In such an embodiment, the first transistor T1 is turned off while the switching control signal DRV has a low level such that the power supply converter 132 does not generate the LED drive voltage VLED. When the backlight signal BLC provided from the timing controller 122 has a high level, the power supply controller 134 controls a duty ratio of the switching control signal DRV based on a current level of the feedback signal FB. The power supply converter 132 may generate the LED drive voltage VLED of voltage level corresponding to the switching control signal DRV and the mode signal 3D_MODE.

Figure 7:
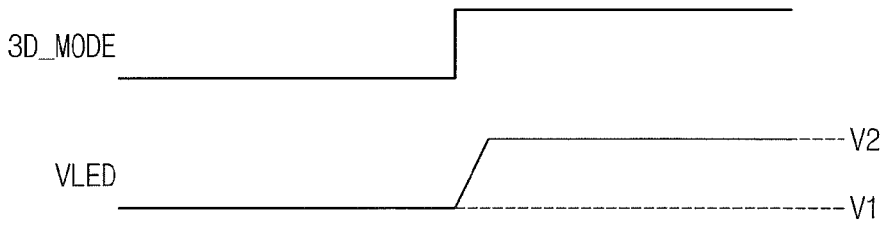
FIG. 7 is a drawing illustrating a change of voltage level of LED drive voltage according to a mode signal.

FIG. 7 is a drawing illustrating a change of voltage level of LED drive voltage according to a mode signal.

Referring to FIGS. 6 and 7, in an exemplary embodiment, when the mode signal 3D_MODE transits from a low level corresponding to the normal mode to a high level corresponding to the 3D image display mode, the power supply converter 132 serially connects the boosting winding LS2 and the first secondary winding LS1 to increase a voltage level of the LED drive voltage VLED from a first voltage level V1 to a second voltage level V2. Therefore, the display device 100 illustrated in FIG. 1 displays an image without deterioration of brightness during the 3D image display mode.

In an exemplary embodiment, the backlight unit of the display device may generate the LED drive voltage for each of the normal mode and the 3D image display mode such that deterioration of brightness and image quality are effectively prevented, even when the backlight unit is periodically turned on and turned off in the 3D image display mode. In an exemplary embodiment, an on/off duty change of the switching transistor may be minimized when a display mode of the display device is changed from the normal mode to the 3D image display mode, and a level changing speed of the LED drive voltage may become high.

The above-disclosed subject matter is to be considered illustrative, and not restrictive, and the appended claims are intended to cover all such modifications, enhancements, and other embodiments, which fall within the true spirit and scope of the invention. Thus, to the maximum extent allowed by law, the scope of the invention is to be determined by the broadest permissible interpretation of the following claims and their equivalents, and shall not be restricted or limited by the foregoing detailed description.

What is claimed is:

1. A backlight unit comprising:

a power supply converter comprising:

a primary winding connected to an input power supply voltage; and a secondary winding which is connected to an output node and outputs a light emitting diode drive voltage to the output node in response to a mode signal and a switching control signal; and a light emitting diode string connected to the output node of the power supply converter, wherein the power supply converter serially connects a boosting winding to the secondary winding and the output node and when the mode signal represents a three dimensional image display mode, outputs a boosted light emitting diode drive voltage to the output node through the boosting winding, and wherein the boosting winding is bypassed when the mode signal represents a normal mode.

2. The backlight unit of claim 1, wherein the power supply converter further comprises:

a bypass control circuit configured to generate a bypass signal in response to the mode signal, wherein the bypass control circuit comprises a bypass unit configured to bypass a first end and a second end of the boosting winding in response to the bypass signal, and wherein the first and second ends of the boosting winding are bypassed through the bypass unit based on the bypass signal when the mode signal represents the normal mode.

3. The backlight unit of claim 2, wherein the bypass unit comprises a transistor including a current path connected between the first and second ends of the boosting winding and a gate terminal connected to the bypass signal.

4. The backlight unit of claim 2, wherein the bypass control circuit comprises:

a first resistor connected between the first end of the boosting winding and a first node;

a second resistor having a first end connected to the first node and a second end; and a transistor including a current path, which is connected between the second end of the second resistor and a ground voltage, and a gate connected to the mode signal, wherein a signal at the first node is the bypass signal.

5. The backlight unit of claim 1, wherein the power supply converter further comprises:

a transistor including a current path connected between a ground voltage and a connection node of the primary winding and the secondary winding, and a gate which receives the switching control signal.

6. The backlight unit of claim 5, further comprising:

a power supply controller which is connected to an end of the light emitting diode string and outputs the switching control signal based on a current at the end of the light emitting diode string.

7. The backlight unit of claim 6, wherein the power supply controller outputs the switching control signal in response to a backlight control signal, and the power supply converter is periodically turned on and turned off based on the switching control signal from the power supply controller.

8. The backlight unit of claim 1, wherein the primary winding, the secondary winding and the boosting winding are sequentially connected in series between the input power supply voltage and the output node.

9. The backlight unit of claim 1, wherein the light emitting diode voltage less than the boosted light emitting diode drive voltage is output to the output node in the normal mode.

10. A display device comprising:

a display panel comprising a plurality of pixels;

a drive circuit which controls the display panel to display an image on the display panel; and a backlight unit which supplies light to the display panel, wherein the backlight unit comprises:

a power supply converter which outputs a light emitting diode drive voltage to an output node in response to a mode signal and a switching control signal, wherein the power supply converter comprises:

a primary winding connected to an input power supply voltage; and a second winding connected to the primary winding and the output node;

a light emitting diode string connected to the output node of the power supply converter, wherein the power supply converter serially connects a boosting winding to the secondary winding when the mode signal represents a three-dimensional image display mode, and outputs a boosted light emitting diode drive voltage to the output node through the boosting winding, and wherein the boosting winding is bypass signal when the mode signal represents a normal mode.

11. The display device of claim 10, wherein the drive circuit generates the mode signal corresponding to an operation mode of the display panel.

12. The display device of claim 11, the power supply converter further comprises:

a bypass control circuit configured to generate a bypass signal in response to the mode signal, wherein the bypass control circuit comprises a bypass unit configured to bypass a first end and a second end of the boosting winding in response to the bypass signal.

13. The display device of claim 12, wherein the bypass unit comprises a transistor including a current path connected between the first and second ends of the boosting winding and a gate terminal connected to the bypass signal.

14. The display device of claim 13, wherein the bypass control circuit comprises:

a first resistor connected between the first end of the boosting winding and a first node;

a second resistor having a first end connected to the first node and a second end; and a transistor including a current path connected between the second end of the second resistor and a ground voltage and a gate connected to the mode signal, wherein a signal at the first node is the bypass signal.

15. The display device of claim 12, wherein the power supply converter further comprises:

a transistor including a current path formed between a ground voltage and a connection node of the primary winding and the secondary winding, and a gate controlled by the switching control signal.

16. The display device of claim 15, wherein the backlight unit further comprises:

a power supply controller which is connected to an end of the light emitting diode string and outputs the switching control signal based on a current at the end of the light emitting diode string.

17. The display device of claim 16, wherein the power supply controller outputs the switching control signal in response to a backlight control signal, and the power supply converter is periodically turned on and turned off based on the switching control signal from the power supply controller.

18. The display device of claim 17, wherein the display panel further comprises:

a plurality of gate lines extending in a first direction; and a plurality of data lines extending in a second direction and crossing the data lines, wherein each of the pixels is connected to a corresponding gate line of the gate lines and a corresponding data of the data lines, wherein the drive circuit comprises:

a data driver which drives the data lines;

a gate driver which drives the gate lines; and a timing controller which in response to an image signal and a control signal received from outside, provides an image data signal and a first control signal to the data driver, provides a second control signal to the gate driver and generates the mode signal and the backlight control signal.

19. The display device of claim 12, wherein the bypass control circuit generates the bypass signal such that the first and second ends of the boosting winding are bypassed through the bypass unit when the mode signal represents a normal mode.

20. The display device of claim 19, wherein the boosted light emitting diode drive voltage output to the output node of the power supply converter during the three-dimensional image display mode is higher than the light emitting diode drive voltage output to the output node of the power supply converter during the normal mode.

* * * * *